US005149276A

United States Patent [19]

Dixon

[11] Patent Number: 5,149,276

[45] Date of Patent: Sep. 22, 1992

[54] MODULAR HOLDER HAVING AN EJECTOR MECHANISM FOR A DUAL IC PACKAGE

[75] Inventor: Dirk R. Dixon, Elizabethtown, Pa.

[73] Assignee: AMP Incorporated, Harrisburg, Pa.

[21] Appl. No.: 809,352

[22] Filed: Dec. 18, 1991

[51] Int. Cl.[5] ..... H01R 13/62

[52] U.S. Cl. ..... 439/159

[58] Field of Search ..... 439/152-160, 439/629-637

[56] References Cited

U.S. PATENT DOCUMENTS

| | | | |
|---|---|---|---|
| 3,181,906 | 5/1965 | De Rose et al. | 439/160 |
| 4,780,792 | 10/1988 | Harris et al. | 439/160 |
| 4,836,790 | 6/1989 | Narita | 439/68 |
| 5,011,420 | 4/1991 | Sakamoto | 439/152 |
| 5,026,296 | 6/1991 | Hashiguchi | 439/159 |
| 5,033,972 | 7/1991 | Komatsu et al. | 439/153 |

*Primary Examiner*—Joseph H. McGlynn

*Attorney, Agent, or Firm*—Katherine A. Nelson

[57] ABSTRACT

A modular holder (10) for two-memory cards (132, 134) that enables separate insertion and injection of the cards from the holder (10) includes a central plate (44) fixed between opposed side rails (12, 14) intermediate the upper and lower surfaces thereof; first and second ejector plates (64, 66) movably held between the side rails (12, 14) and spaced above and below the center plate (44) and essentially parallel therewith; first and second rocker arms (84, 86) adapted to move respective ones of the first and second ejector plates (64, 66) from a first position wherein the associated memory card is electrically connected to terminals in an associated connector (120) to a second position wherein the memory card is disconnected from the connector (120), the rocker arms (84, 86) being disposed between the center plate (44) and the respective ejector plates (64, 66), and means (100, 102) to activate the eject mechanism.

2 Claims, 7 Drawing Sheets

MODULAR HOLDER HAVING AN EJECTOR MECHANISM FOR A DUAL IC PACKAGE

FIELD OF THE INVENTION

The present invention relates to a modular holder for IC packs, such as a memory card, and more particularly to a device having an eject mechanism for removing the cards from the holder.

BACKGROUND OF THE INVENTION

IC packs or memory cards are used in a variety of electronic equipment. Memory cards contain a number of circuits, which are interconnected to corresponding circuits of a circuit board by means of a header connector mounted thereto. The memory cards are typically supported by some type of frame or structure so that the contacts at the mating edge of the memory card will be aligned with the contacts of the header upon inserting the card into the holder. Since the card may need to be removed from electrical engagement with the connector, it is desirable that there be some means to readily eject the card from electrical engagement with the connector.

U.S. Pat. No. 4,836,790 discloses a header device having means for ejecting an IC pack which includes a pair of first levers that abut an end portion of the IC pack and a pair of second levers located outside the holder which when rotated cause movement of the first levers to pull the IC pack from the header. U.S. Pat. No. 4,640,545 also discloses a lever mechanism attached to the header for ejecting the IC pack.

U.S. Pat. No. 5,011,420 discloses a card holder having an ejection mechanism which includes a U-shape member that wraps around the mating end of the card and is attached to a lever mechanism on the card holder. Upon activating the lever, the U-shape member pulls against the end of the card to eject it from the holder. Another eject mechanism within the card holder is also disclosed in U.S. Pat. No. 5,033,972.

Each of the above prior art devices is designed to be used with a single card. If a desired array of cards is to be used, a plurality of the devices may be stacked one upon the other with sufficient spacing allowed for operation of the eject mechanism. Typically the memory cards are used in conjunction with header connectors mounted on daughter cards, a plurality of which are electrically engaged to a mother board. To facilitate the manufacturer of electronic equipment, it is desirable that the daughter cards be spaced as closely together as possible. The height of the memory card device, particularly when used in a stacked array, therefore, needs to be minimized to allow the close spacing of the daughter boards.

It is an object of the present invention to provide a modular memory card holder that minimizes the space between adjacent cards while providing means for readily ejecting the cards from the holder.

SUMMARY OF THE INVENTION

Accordingly, this invention is directed to a modular holder for two-memory cards that enable separate insertion and ejection of the cards from the holder. The holder includes a central plate fixed between opposed side rails intermediate the upper and lower surfaces thereof; first and second ejector plates movably held between the side rails and spaced above and below the center plate essentially parallel therewith; first and second rocker arms adapted to move respective ones of the first and second ejector plates from a first position wherein the associated memory card is electrically connected to terminals of an associated connector to a second position wherein the memory card is disconnected from the connector, the rocker arms being disposed between the center plate and the respective ejector plates, and means to activate the eject mechanism. The rocker arms have first and second ends and an intermediate portion therebetween. The first ends of the arms are attached to the respective ejector plates and the second ends are engaged with the activation means. The intermediate portions of the arms are pivotally mounted to opposite sides of the center plate. The rails are adapted to slidingly receive the memory cards therebetween with one of the cards insertable above the center plate and the other card insertable below the center plate. Each of the ejector plates include at least two tab portions extending essentially perpendicular to the major surfaces of the ejector plate and adapted to engage the memory cards at the mating edge thereof. The first and second activation means are movable along a respective side rail to engage the second end of the rocker arms and upon movement thereof, the second end causes the rocker arm to pivot about its intermediate position thereby moving the first end away from the connector and moving the ejector plate and the card carried by the plate away from the connector thereby ejecting the card from the card receiving cavity.

In the preferred embodiment the holder further includes an upper cover securable to the side rails and defining a first card receiving region. Upon mounting the holder to a circuit board and aligning it with a connector, a second card receiving region is formed between the second ejector plate and the surface of the circuit board. Upon inserting memory cards into the respective card receiving regions the cards can be moved into electrical engagement with the connector. Upon pushing the appropriate activating means, the ejector plate can be moved to pull the memory card from the respective cavity.

It is an object of the present invention to provide a push to eject mechanism for memory cards in a stacked relationship.

It is a further object of the invention to provide a holder for a dual memory card stacked that minimizes the height required for the apparatus.

An embodiment of the present invention will now be described by way of example with reference to the accompanying drawings.

DETAILED DESCRIPTION OF THE DRAWINGS

Figure 1:
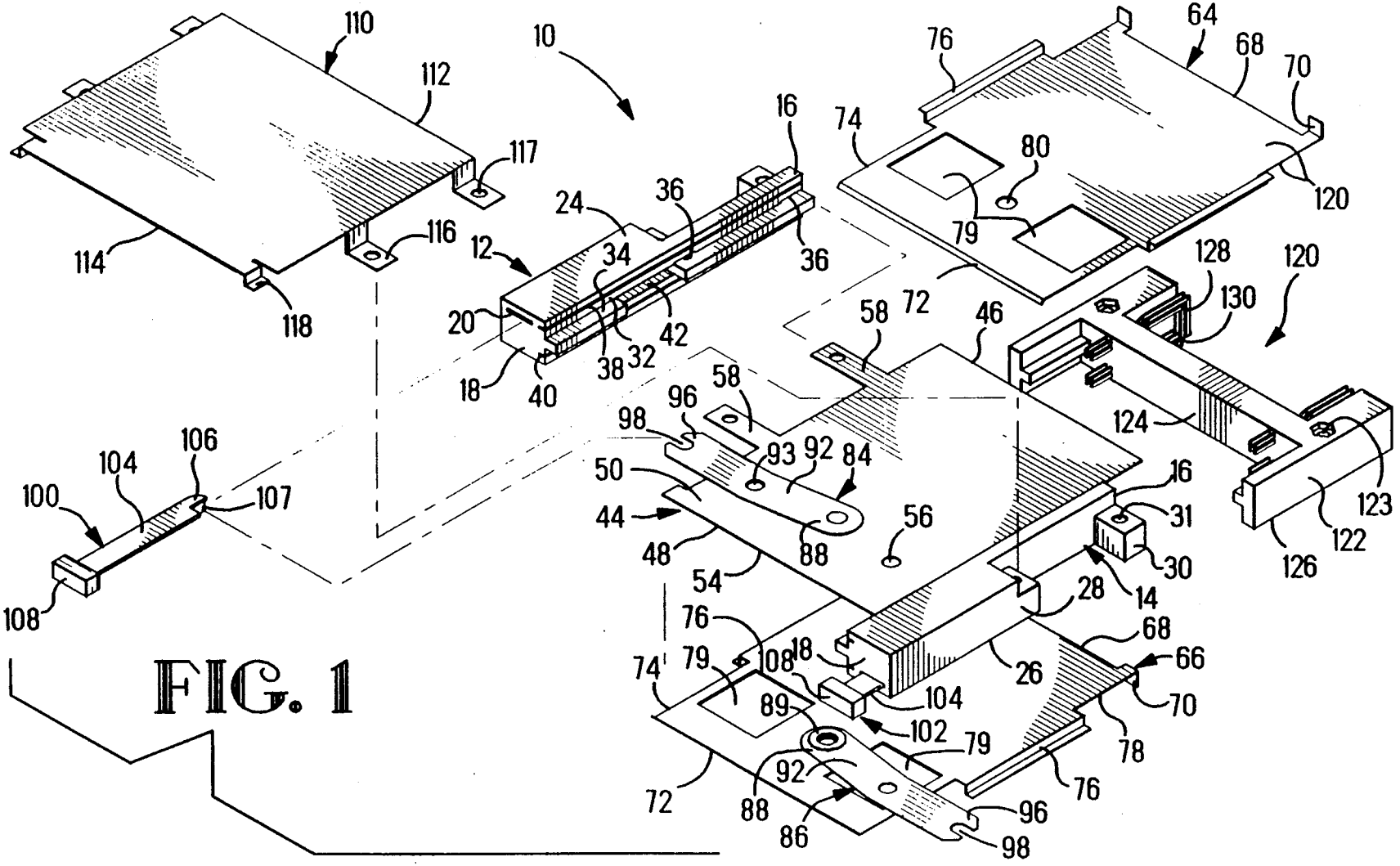
FIG. 1 is an exploded perspective view of the modular holder of the present invention and a header connector with which the invention is used.
Figure 2:
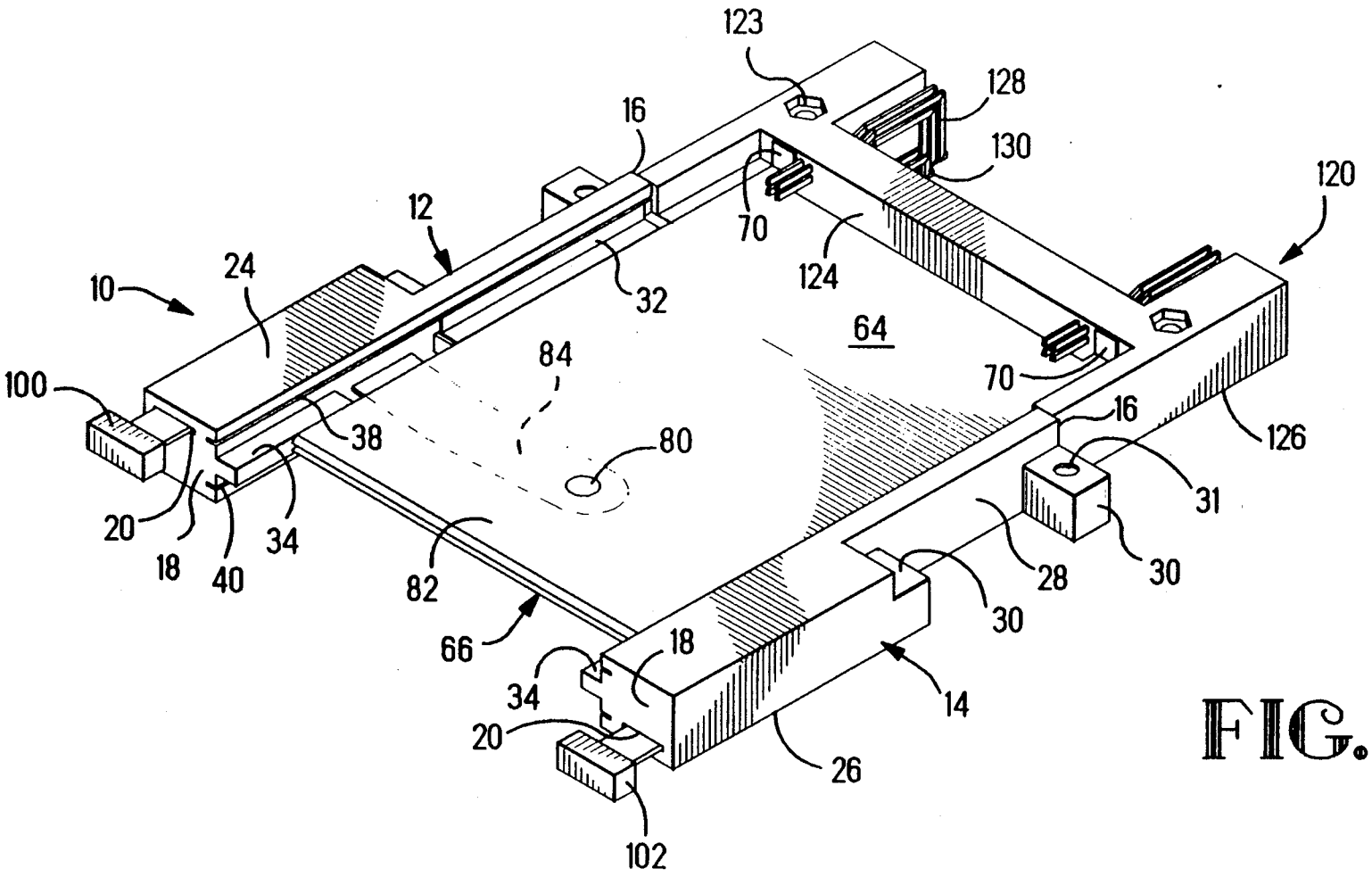
FIG. 2 is an assembled view of the modular holder with the cover removed.
Figure 3:
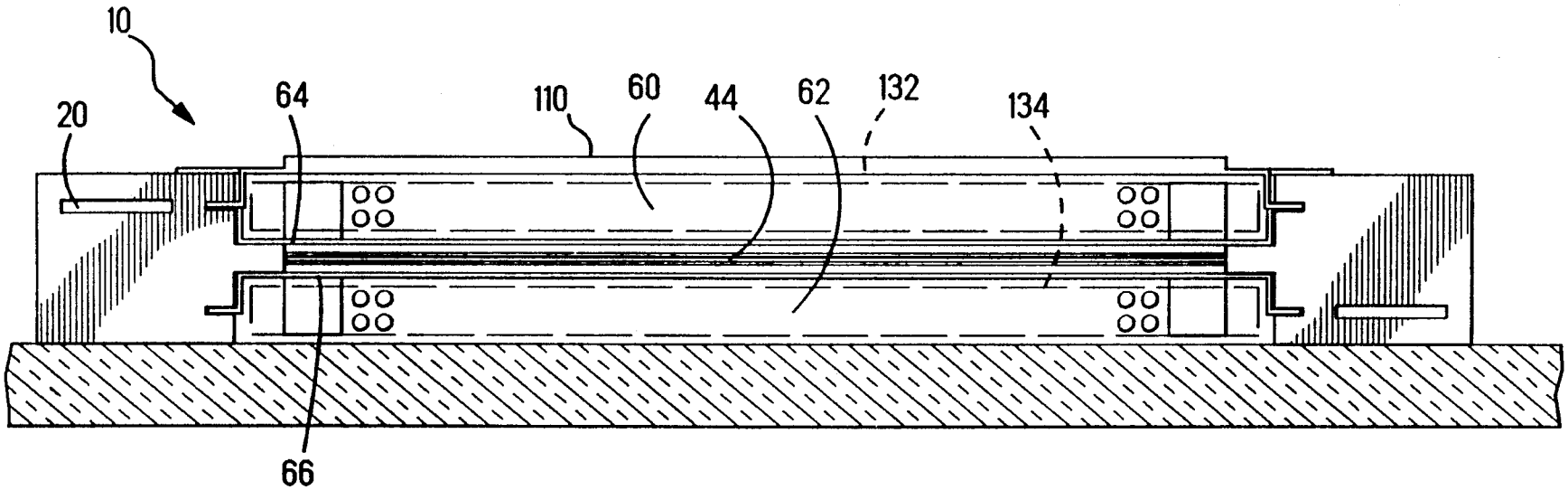
FIG. 3 is a front view of the holder having two memory cards inserted therein.
Figure 4:
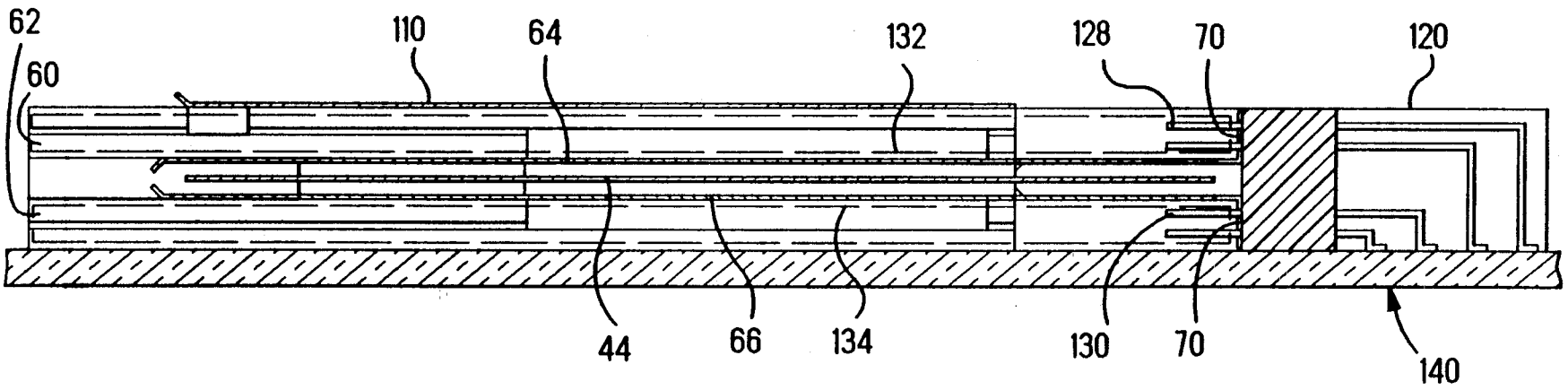
FIG. 4 is a longitudinal sectional view of the holder having memory cards therein electrically engaged with the connector.

Referring now to FIGS. 1 and 2 modular holder 10 includes first and second side rails 12,14, central plate 44, first and second ejector plates 64,66, first and second rocker arms 84,86, first and second activation means 100,102, and in the preferred embodiment a cover 110. For purposes of describing the invention, the same numbers will be used wherever possible for corresponding parts of duplicate members. The modular holder 10 is designed to hold two memory cards 132,134 as best seen in FIGS. 3 and 4 such that the memory cards are electrically engaged to an electrical connector such as the dual header 120 as best seen in FIGS. 1 and 4. Connector 120 includes a housing 122 having mounting holes 123 extending therethrough for securing connector 120 to a circuit board 140 as best seen in FIG. 4. Referring again to FIG. 1 and 2, connector 120 has a card mounting face 124, a board mounting face 126 and a plurality of first terminals 128 and second terminals 130. The first terminals 128 are adapted to mated to a first memory card 132 and the second terminal members 130 are adapted to be mated with a second memory card 134 as shown in FIG. 4.

Figure 5:
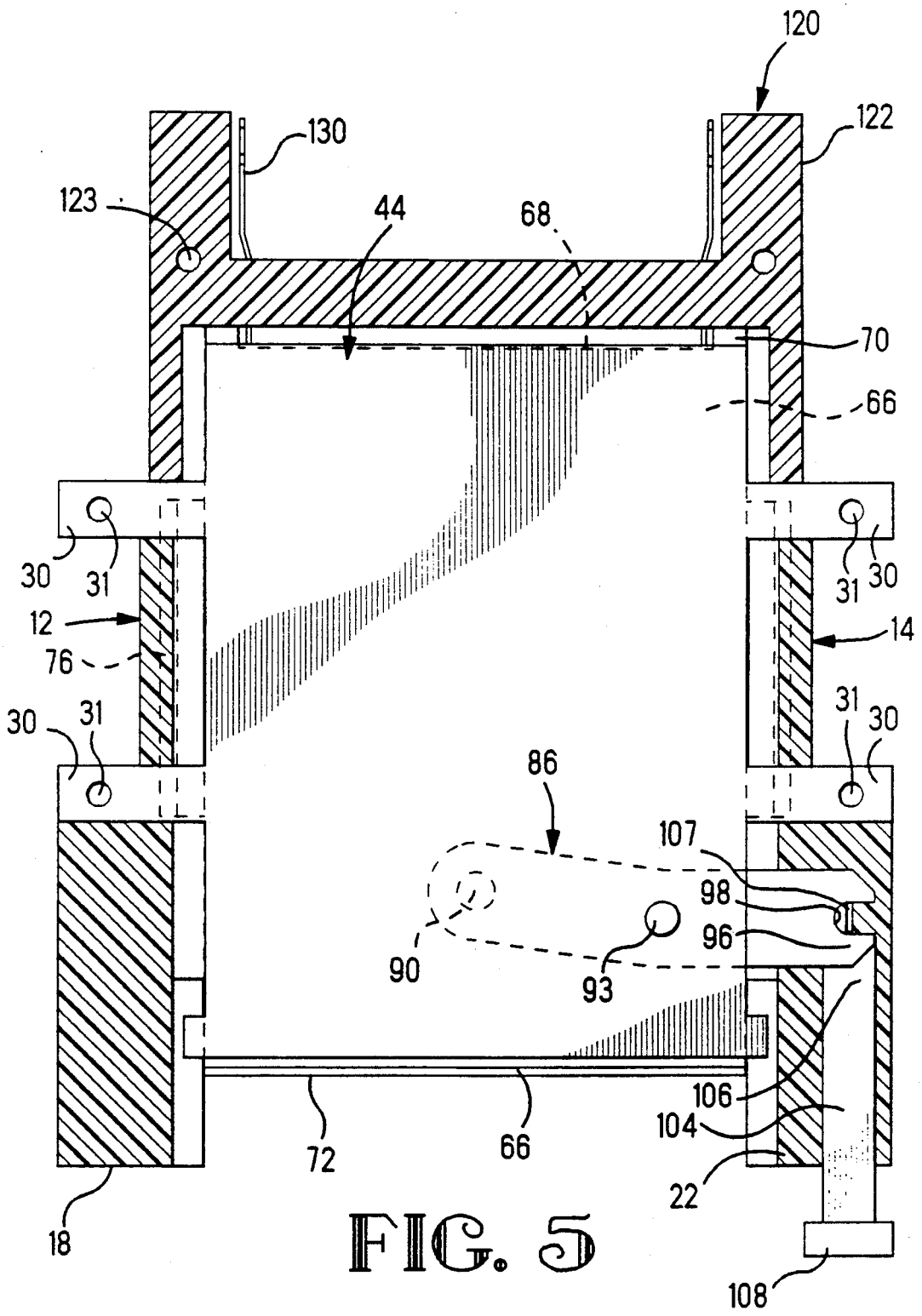
FIGS. 5, 6 and 7 illustrate the operation of the ejector mechanism of the present invention.
Figure 6:
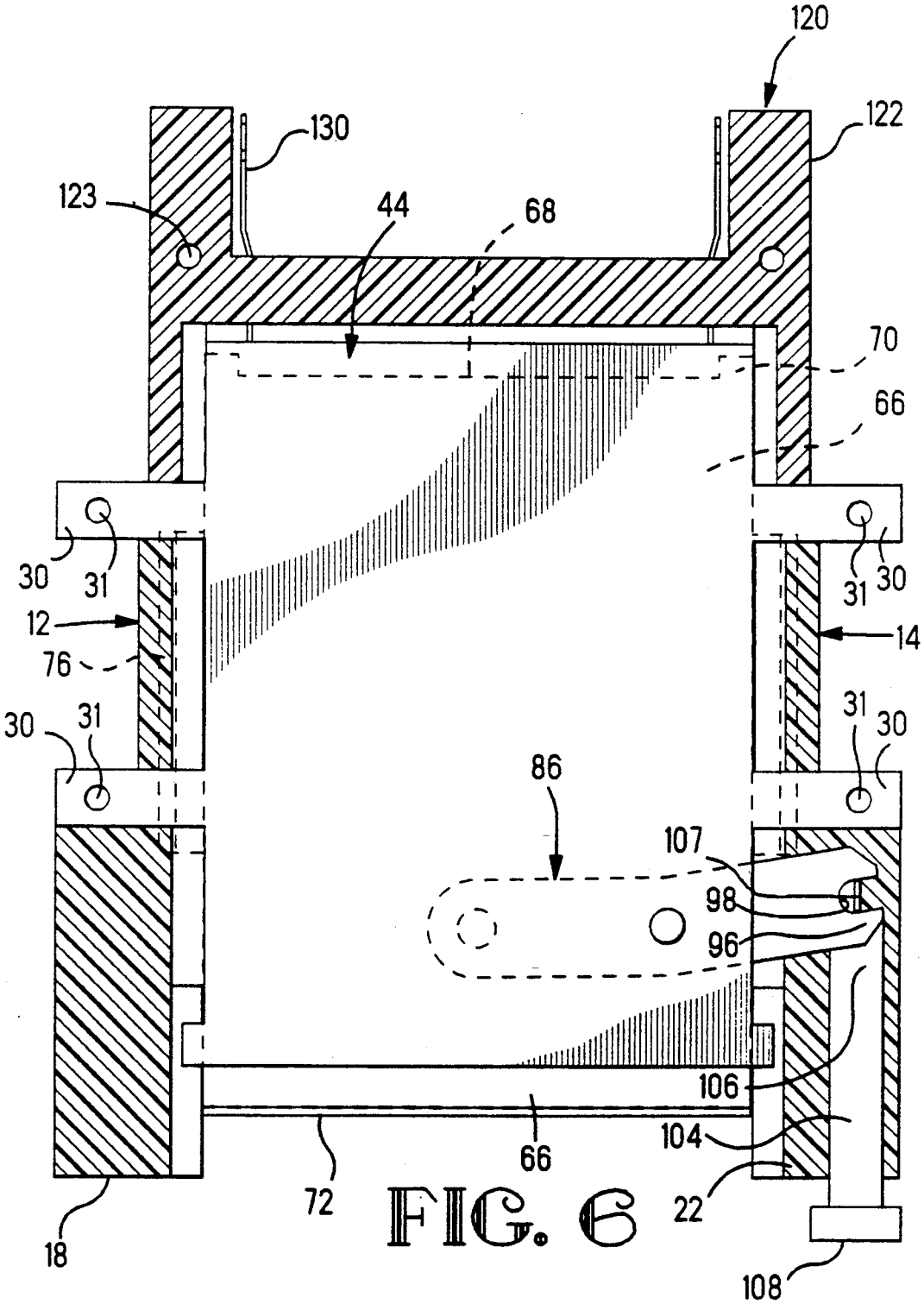
Figure 7:
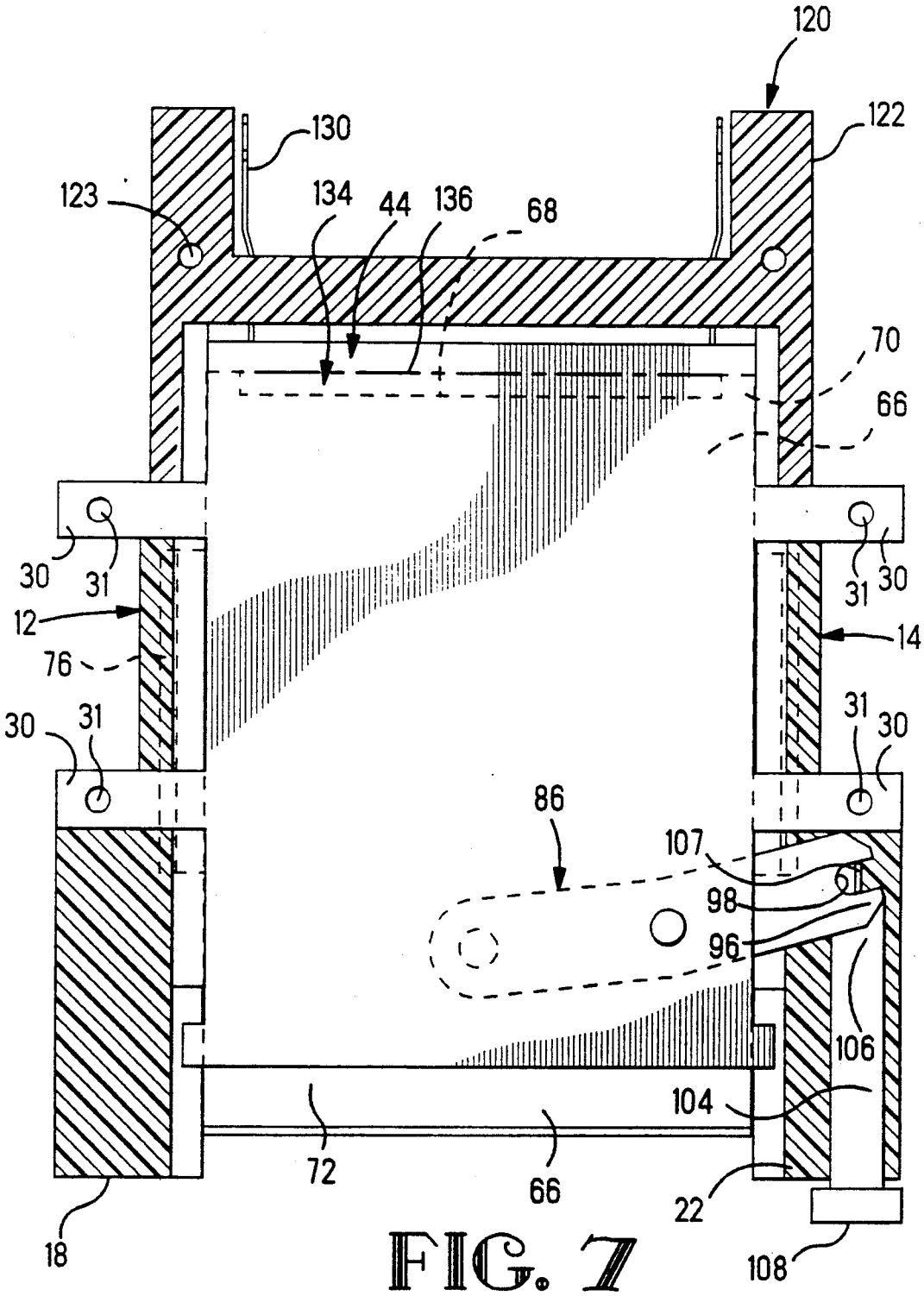

First and second rails 12,14 have rearward or connector proximate ends 16, forward or card receiving ends 18, opposed upper and lower surfaces 24,26 and opposed outer and inner surfaces 28,32. Rails 12 and 14 further have mounting flanges 30 extending outwardly along the outer edges 28. Mounting flanges 30 include holes 31 for receiving mounting means (not shown) for securing the modular holder 10 to a circuit board 140 as shown in FIG. 4. The forward rail ends 18 are adapted to include the respective first and second activation means or plungers, 100,102. Forward rail ends 18 are, therefore, larger than the rearward ends 16. Ends 18 include a slot 20 along the forward face thereof and in communication with plunger cavity 22 within the rail, as shown in FIGS. 5–7. The push button ends 108 of first and second activation means 100,102 extend outwardly from respective slots 20. The operation of the activating mechanism will be discussed more fully below.

The inner surfaces 32 of the respective rails 12,14 include an inwardly directed projection 34 substantially midway between the upper and lower surfaces 24,26 that provides support for the center plate 44. Inner surfaces 32 further include a plurality of center plate receiving slots 36 and upper and lower slots 38,40 for receiving portions of first and second ejector plates 64,66 respectively, as more fully explained below. The inner surfaces 32 also include a slot 42 for receiving end 96 of one of the rocker arms 84,86.

Central plate 44 has a connector proximate end 46 and a card receiving end 48, opposed upper and lower major surfaces 50,54 and a plurality of projections 58 extending outwardly along the lateral edges thereof and adapted to engage slots 36 of respective side rails 12,14 when holder 10 is assembled. The combination of slots 36 holds the central plate 44 securely between the rails 12,14. As shown in FIG. 2 when the holder is secured to a circuit board adjacent a connector 120, the connector proximate end 46 of the central plate is proximate the mating face 124 of connector. As best seen in FIGS. 1, 3 and 4 central plate 44 divides the holder into first and second card receiving regions 60,62.

First and second ejector plates 64,66 have connector proximate ends 68, card receiving ends 72 and lateral edges 74 extending therebetween. As best seen in FIGS. 1 and 2, ejector plates 64,66 further include outwardly extending tabs 70 at the connector proximate ends 68, opposed major surfaces 78, and arm mounting means 80. The first and second ejector plates 64,66, as best seen in FIG. 1, are placed in holder 10 on opposite sides of the central plate 44 with the corresponding tabs 70 extending into the respective first and second card receiving regions 60,62; as seen in FIG. 4. The ejector plates 64,66 are substantially parallel to the central plate 44. The first and second ejector plates 64,66 further include formed rail sections 76, which engage the upper and lower slots 32,40 respectively of the side rails 12,14. The slots 32, 40 extend from the card receiving rail ends 18 to the connector proximate ends 16, providing support for and allow the ejector plates 64,66 to move back and forth within the holder 10. As also shown in FIG. 1, ejector plates 64, 66 include window-like apertures 79 extending therethrough proximate the card receiving edges thereof. Apertures 79 provide access for tooling required to assemble holder 10, as more fully described below. For purposes of illustrating the invention, apertures 79 have been shown in FIG. 1 only.

Side rails 12,14 and ejector plates 64,66 are configured to provide a "funneling effect" or channel to move the respective memory cards into holder 10 and in general alignment with connector 120. The final alignment for the mating of the cards and terminals of the connector 120 is provided by the structure of the connector housing 122 as is known in the art.

First and second rocker arms 84,86 are disposed between the respective first and second ejector plates 64,66 and the opposed major surfaces 24,26 of central plate 44 as best seen in FIG. 1. The position of the first rocker arm 84 is shown in phantom in FIG. 2. First and second rocker arms 84,86 have first ends 88, second ends 96 and intermediate portions 92 extending therebetween. The first ends 88 of the respective rocker arms 84,86 are pivotally secured by means 90, such as an integrally formed or drawn rivet or the like, to respective ejector plates 64,66 substantially centrally of the opposed side rails 12,14 and proximate the card receiving ends 72 thereof. The second ends 96 extend beyond the lateral edges 74 of the respective first and second ejector plates 64,66 toward opposite rails 12,14. The corresponding intermediate portions 92 of the first and second rocker arms 84,86 are adapted to be pivotally secured to the upper and lower surfaces 24,26 of central plate 44 proximate the card receiving end thereof and proximate the associated side rail 12, 14 by means such as drawn rivets 93. As best seen in FIGS. 5, 6 and 7 the second ends 96 of the respective first and second rocker arms 84,86 extend into slots 42 in the enlarged forward portion of the respective rails 12,14 and are adapted to be engaged by tabs 107 at the leading ends 106 of activating means 100,102 therein. As can be seen from FIGS. 1, 2 and 5 to 7 the rocker arms 84,86 are slightly angled in their intermediate portions 92 to minimize any sideways movement by the ejector plates 64,66 as the plates 64,66 are moved into and out of holder 10 by the action of the respective rocker arms 84,86.

As best seen in FIGS. 5 through 7 the respective first and second activation means or plungers 100, 102 include elongate portions 104 having a tab 107 at the leading 106 thereof for engaging rocker arms 84,86 and a push button end 108 which extends outwardly from the forward ends 18 of the respective rails 12,14 along the card receiving face of the holder 10. As shown in FIG. 2, first plunger 100 is positioned close to the upper surface 24 of the rail 12 and operates the first or upper ejector plate 64 and the second plunger 102 is proximate the lower surface 26 of rail 14 and operates the lower or second ejector plate 66.

Referring again to FIG. 1, cover 110 has connector proximate end 112, card receiving end 114 and mounting tabs 116 having apertures 117 therethrough extend outwardly from lateral edges of cover 110. In the assembled holder, apertures 117 are aligned with apertures 31 in mounting flanges 30 for receiving mounting means (not shown)to mount holder 10 to board 140. Tabs 118 extend outwardly from the lateral edges proximate card receiving end 114 and engage leading ends of slot 38 forward of rails 76 of ejector plate 64, thereby preventing the card receiving edge 114 of cover 110 from being lifted up when a memory card 132 is inserted into the first card receiving region 60.

The operation of the rocker arms 84,86 and plungers 100, 102 is best understood by referring to FIGS. 5 through 7, which show a cross sectional view of the holder 10 and connector 120 taken just above the central plate 44 and between central plate 44 and first rocker arm 84. Rocker arm 86 is shown in phantom between central plate 44 and the second ejector plate 66. FIG. 5 shows the second ejector plate 66 in the inward most position wherein a memory card held thereby is in electrical engagement with the corresponding terminals 130 of connector 120. As can be seen in FIG. 5 the push button 108 of activation means or plunger 102 is extended outwardly from the card receiving face of the modular holder 10 and the rocker arm 86 is in the further most forward position within activation cavity 22 of rail 14. As force is applied to the push button end 108 of the second plunger 102, the leading end 106 thereof moves toward the connector proximate end of the modular holder 10, thereby moving the second end 96 of the rocker arm 86 in the same direction causing the rocker arm 86 to pivot about its intermediate position 92 thereby moving the second ejector plate 66 forward toward the card receiving face of modular holder 10, as shown in FIG. 6. As the second end 96 of the second rocker arm 86 is moved to its most rearward position, as shown in FIG. 7, rocker arm 86 continues to pivot about its intermediate portion 92 whereby the second ejector plate 66 is moved outwardly of the modular holder 10 and the second memory card 134 associated therewith is ejected from the modular holder 10, as shown in FIG. 7. As ejector plate 66 is moved forwardly, the downward extending card gripping tabs 70, which engage the connector mating edge 136 of the memory card 134, shown by the dotted line in FIG. 7, exert force against the edge 136 to disconnect the memory card 134 from the corresponding terminals 130 as the second ejector plate 66 is moved forward within the modular holder 10. Upon full ejection, the card 134 extends outwardly of the modular holder 10 and can be readily removed therefrom. The first ejector plate 64, first rocker arm 84 and first activating mechanism 100 work in the same manner as described with the second ejector plate 66 and rocker arm 86.

In the preferred embodiment, rails 12,14 are molded from a suitable dielectric material such as known in the art. The central plate 44, ejector plates 64,66, rocker arms 84,86 and cover 110 are made from metal, preferably steel.

In assembling the holder 10, rocker arms 84,86 are secured to the respective ejector plates 64,66 and central plate 44 by means of the drawn rivets 90, 93 or the like, apertures 79, as shown in FIG. 1, providing access for the tooling necessary to peen the rivets or other fastening means. After the plunger or activation means 100,102, are inserted into the corresponding rails, the plate and rocker arm subassembly is inserted between rails 12, 14 and into the associated slots 38,36,40,42 to hold the plates and arms in alignment in the holder. As the second ends 96 of rocker arms 84,86 are received in their respective rail slots 42 plunger tabs 107 are received into slots 98 of arm ends 96, thereby securing plunger arms 100,102 in their respective rails 12, 14. The rails 12,14 and the basic structure and cover 110 are then mounted to the circuit board 140 as a unit, such that the connector proximate rail ends 16 essentially abut the ends of connector 120 by mounting means (not shown) inserted through apertures 31 in mounting flanges 30 of the rails 12,14.

The present invention provides a modular holder for two-memory cards that enable separate insertion and ejection of the cards from the holder. As can be appreciated from the foregoing description, the use of the same central plate 44 to anchor the respective rocker arms 84,86, minimizes the height required for the dual memory card. Thus circuit boards and electronic equipment can be placed more closely together rather than was previously attainable from stacking of completely separate mechanisms.

It is thought that the modular holder and the dual stacking holder and assembly of the present invention and many of its attendant advantages will be understood from the foregoing description. Changes may be made in the form, construction and arrangement of parts thereof without departing from the spirit and scope of the invention or sacrificing all of its material advantages.

I claim:

1. A modular holder for two memory cards, each card adapted to be electrically engaged with electrical means of an electrical connector, said holder enabling separate insertion and ejection of said cards from said holder, said holder comprising:

a central plate affixed between opposed side rails intermediate upper and lower surfaces thereof, said central plate having a connector proximate end and a card receiving end and opposed major surfaces, said rails being adapted to slidingly receive said memory cards therebetween such that one of said cards is insertable above said center plate and the other of said cards is insertable below said center plate said center plate defining first and second card receiving regions when said holder is mounted to a circuit board;

first and second ejector plates movably held between said side rails and spaced above and below said center plate and substantially parallel therewith and proximate to respective upper and lower major surfaces of said center plate, each said ejector plate having a connector proximate end and a card receiving end and opposed lateral edges extending therebetween, each connector proximate end further including at least two tab portions extending essentially perpendicularly thereto and in a direction away from said center plate and into respective card receiving regions; said tab portions being adapted to engage connector proximate surfaces along a side of a said memory card upon said cards being received into said card receiving regions;

first and second rocker arms adapted to move respective ones of said first and second ejector plates from a first position wherein the associated one of said memory cards is electrically connected to said connector to a second position wherein said memory card is disconnected from said connector, said first and second rocker arms being disposed.

said first rocker arm having first and second ends and an intermediate portion therebetween, said first end being rotatably secured to said first ejector plate substantially centrally of the opposed side rails and proximate the card receiving edge thereof, said second end extending beyond said lateral edge of said first ejector plate proximate of the side rails and said intermediate portion being pivotally secured to one of said major surfaces of said central plate proximate the card receiving edge thereof and said one of said side rails said second rocker arm having first and second ends and an intermediate portion, therebetween, said first end being rotatably secured to said second ejector plate substantially centrally of the opposed side rails and proximate the card receiving edge thereof, said second end extending beyond said lateral edge of said second ejector plate proximate the other of the side rails and said intermediate portion being pivotally secured to the other of said major surfaces of said central plate proximate the card receiving edge thereof and said other of said side rails; and first and second means to activate said first and second rocker arms, said first and second means being movable along a respective side rail to engage a second end of a respective rocker arm and upon movement thereof, said second end causes said rocker arm to pivot about its intermediate position moving said first end away from said connector, thereby moving said ejector plate away from the connector, whereby a card carried by said ejector plate is moved away from the connector by the ejector plate and ejected from the respective card receiving cavity.

2. The modular holder of claim 1 further including a cover adapted to be secured to said holder.

* * * * *